United States Patent [19]

Anderson

[11] 3,940,025

[45] Feb. 24, 1976

[54] AEROSOL SAFETY CAP WITH TWO PIECE FINGER ENTRY

[75] Inventor: Victor F. Anderson, Wenonah, N.J.

[73] Assignee: Shell Oil Company, Houston, Tex.

[22] Filed: Sept. 23, 1974

[21] Appl. No.: 508,364

[52] U.S. Cl. ..... 222/182; 222/402.13

[51] Int. Cl.[2] ..... B65D 83/14; B65D 55/02

[58] Field of Search.... 222/153, 182, 402.1–402.13; 220/306

[56] References Cited

UNITED STATES PATENTS 3,702,668 11/1972 Landen ..... 222/182

*Primary Examiner*—Stanley H. Tollberg
*Assistant Examiner*—Frederick R. Handren

[57] ABSTRACT

An aerosol safety cap of the finger entry type is provided, having an additional safety feature in that there are two separate parts of the safety cap, one of which is rotatable relative to the other and must be rotated to a predetermined position in order to provide finger access to the valve actuating mechanism in the interior of the safety cap.

6 Claims, 10 Drawing Figures

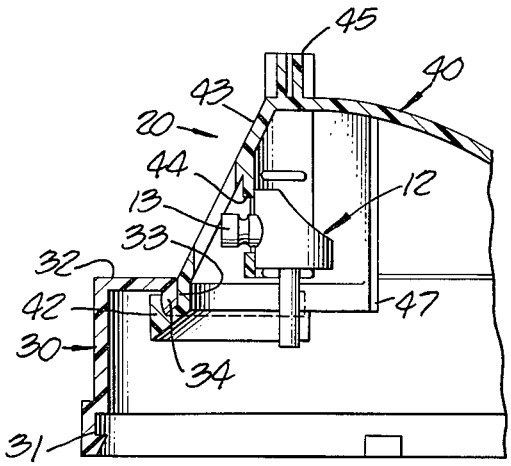
FIG. 7.
FIG. 8.
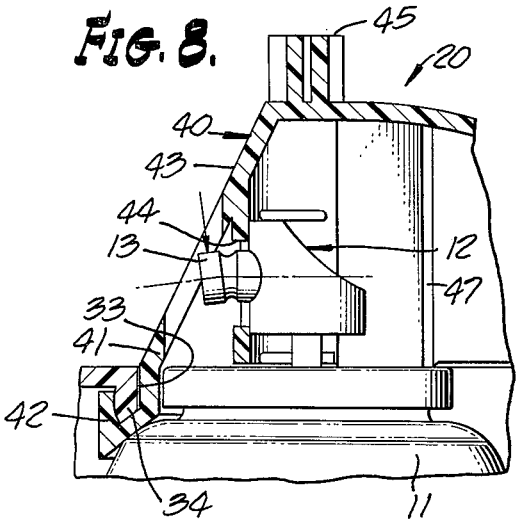
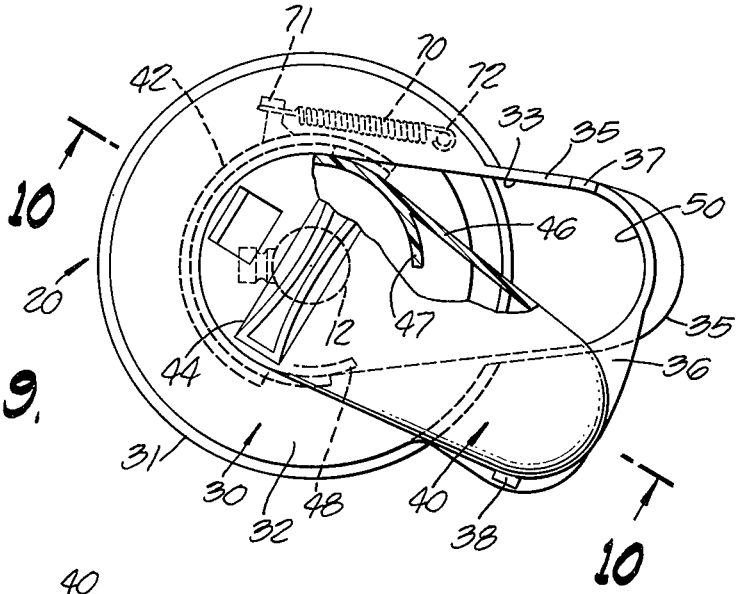
FIG. 9.
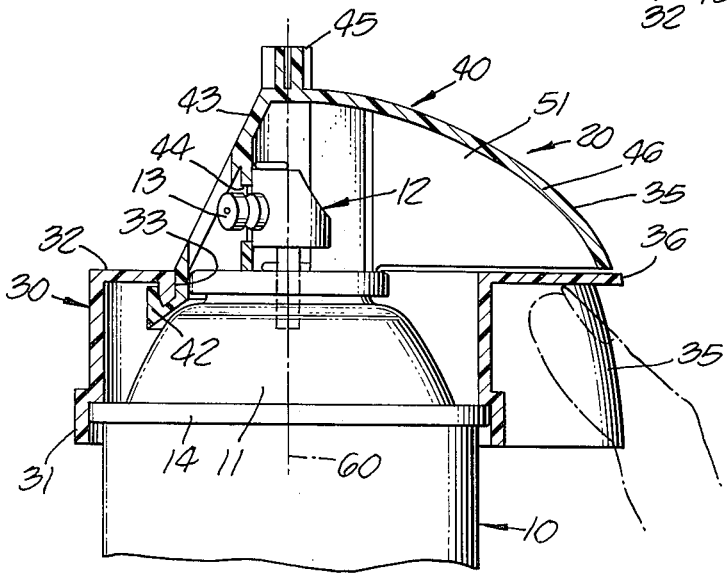
FIG. 10.

AEROSOL SAFETY CAP WITH TWO PIECE FINGER ENTRY

BACKGROUND OF THE INVENTION

Aerosol safety caps of the finger entry type are shown for example in the Corll U.S. Pat. No. 3,712,515.

It is also known in the prior art to provide an aerosol safety cap having two relatively rotatable portions which must be aligned in a predetermined manner in order to make it possible to dispense the contents of the aerosol container. A mechanism of this type is shown in the Landen U.S. Pat. No. 3,702,668.

The object and purpose of the present invention is to provide an aerosol safety cap having dual safety protection capability and which is economical to manufacture, easy to use, and artistic in appearance.

SUMMARY OF THE INVENTION

According to the present invention an aerosol safety cap is provided which has a lower member and an upper member, the upper member being rotatably supported upon the lower member for rotation about a vertical axis relative thereto. The rotatable support is provided in a horizontal plane which lies at the upper extremity of the lower member of the safety cap, and at the lower extremity of the upper member. In one rotational position of the upper member the two cap portions cooperatively provide a finger passageway for access to the interior of the safety cap, so that the usual push button or valve actuator may be depressed for dispensing contents from the associated aerosol container. In another rotational position of the upper cap member, however, finger access to the interior mechanism is not available. This result is achieved by providing a horizontal platform on the lower cap member which effectively blocks access to the finger passageway portion of the upper member, when the upper member is in its alternate position.

According to the preferred form of the invention spring means is included in the apparatus so that the upper cap member is normally held in its non-aligned position, i.e., the alternate position in which finger access to the interior of the safety cap is blocked.

DRAWING SUMMARY

FIG. 7 is a fragmentary cross-sectional view showing the dispensing nozzle and window opening;

FIG. 8 is a view similar to FIG. 7, but showing a particular operating condition;

FIG. 9 is a top plan view of the device in its non-aligned position, and showing the spring mechanism; and FIG. 10 is a cross-sectional elevational view taken on the line 10—10 of FIG. 9.

PREFERRED EMBODIMENT

Reference is now made to FIGS. 1 through 10, inclusive, which illustrate the presently preferred form of the invention.

Figure 1:
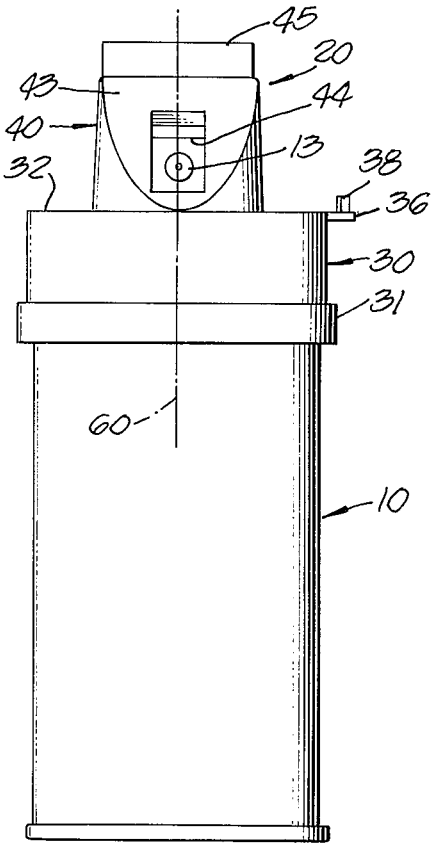
FIG. 1 is a front elevation view of the presently preferred form of the invention.
Figure 2:
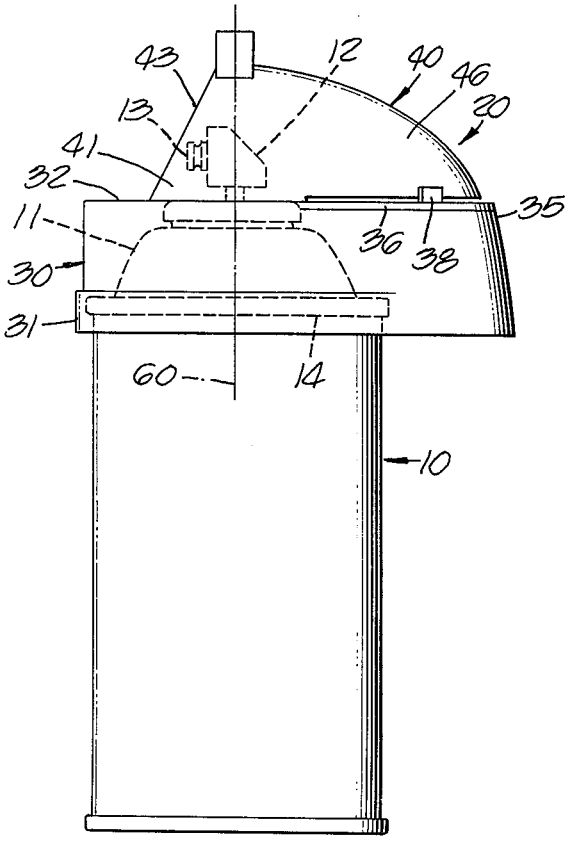
FIG. 2 is a side elevation view.
Figure 4:
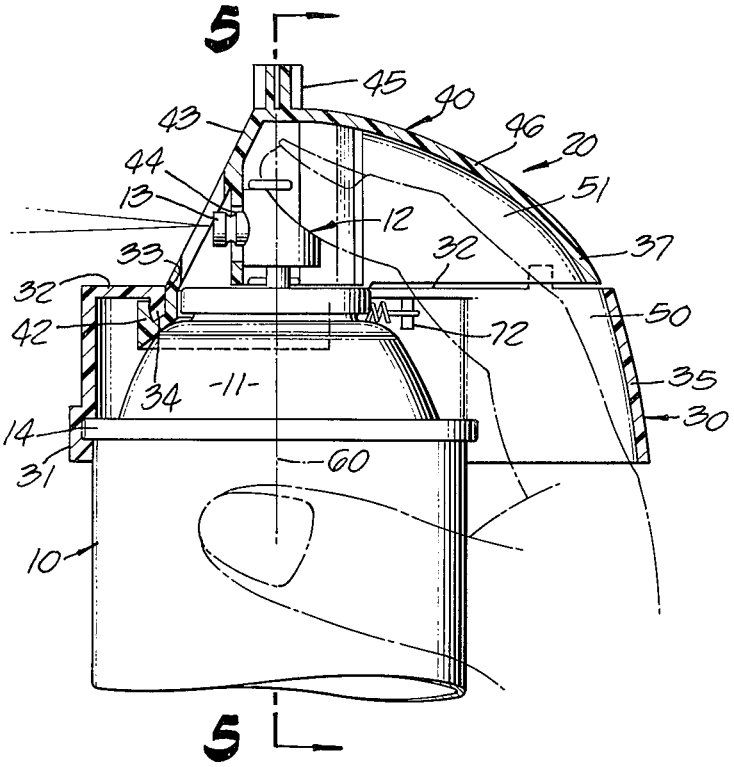
FIG. 4 is a cross-sectional elevation view taken on the line 4—4 of FIG. 3.

Referring particularly to FIGS. 2 and 4 of the drawing, it will be seen that an aerosol container 10 having a pressure dome 11 is provided with a conventional push button or valve actuator 12 above the pressure dome, and a dispensing nozzle 13 associated with the actuator. The safety cap assembly 20, all of which is shown in exploded perspective view in FIG. 6 except for the spring mechanism, is used to cover the upper end of the container 10 in order to prevent the contents of the container from being dispensed by a young child while making it possible nevertheless for the dispensing action to be initiated by an adult.

The safety cap assembly 20 includes a lower member 30, an upper member 40, and a spring 70. For simplicity of the drawings, spring 70 is shown only in FIGS. 3 and 9.

The lower member 30 has a generally bowl-shaped configuration and is disposed in an inverted position, having also a lower rim-like portion 31 which is adapted for securement to the upper end of the aerosol container 10. Lower member 30 also has a top wall 32 which is horizontally disposed and in which a central opening 33 is formed. A flange 34 depends downwardly at the circumference of the opening 33. Additional structural features 35, 36, 37, 38 of the lower member 30 are described in a later paragraph.

Upper member 40 has a generally cup-shaped configuration and is disposed in an inverted position, having a lower rim-like portion 41 which supportingly engages the top wall 32 of the lower member. Top wall 32 of the lower member 30 provides a horizontal plane of rotation of the upper member 40 relative to the lower member, and this rotation takes place about a vertical axis 60. The upper member 40 has an outwardly extending circumferential flange 42 formed on the rim-like portion 41, which circumferential flange 42 engages the undersurface of the top wall 32 of the lower member 30. More specifically, the flange 42 has an upwardly opening recess which receives the flange 34 of lower member 30, and there is an interlocking action between the flanges but the flange 42 of the upper member 40 does not quite touch the undersurface of top wall 32 itself, as may be clearly seen for example in FIG. 5 of the drawings.

By virtue of the central opening 33 in lower member 30 and the open lower end of the upper member 40, the conventional push button or valve actuator 12 associated with the aerosol container 10 occupies the interior portion of the upper member 40, when the safety cap is assembled to the container. The interlocking flanges 42, 34 of the rotatable support for the upper member 40 are preferably located as shown by the drawings, immediately surrounding the upper end portion of the pressure dome 11. In order to make it possible for the dispensing nozzle 13 to dispense the contents of the aerosol container into the surrounding atmosphere the upper member 40 has a window 44 provided in its front sidewall 43. An extending portion 45 provided at the upper extremity of the upper member 40 is provided for ornamentation purposes only.

Figure 3:
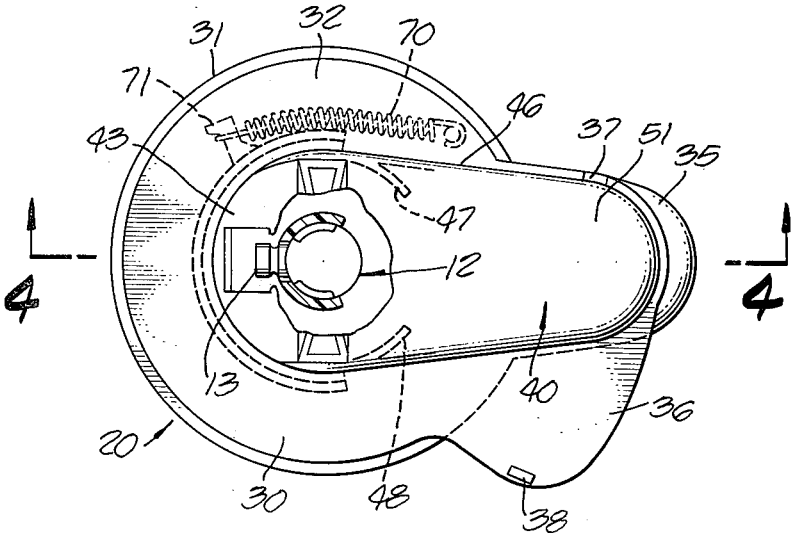
FIG. 3 is a top plan view, partially in cross-section.

The upper member 40 may occupy a first rotational alignment position which may be referred to as the "aligned position", or it may occupy a second rotational alignment position which for convenience may be referred to as the "non-aligned position". The aligned position of the upper member 40 is shown in FIG. 3 of the drawings and also in FIGS. 4 and 5. The non-aligned position of the upper member is shown in drawing FIGS. 9 and 10.

Figure 5:
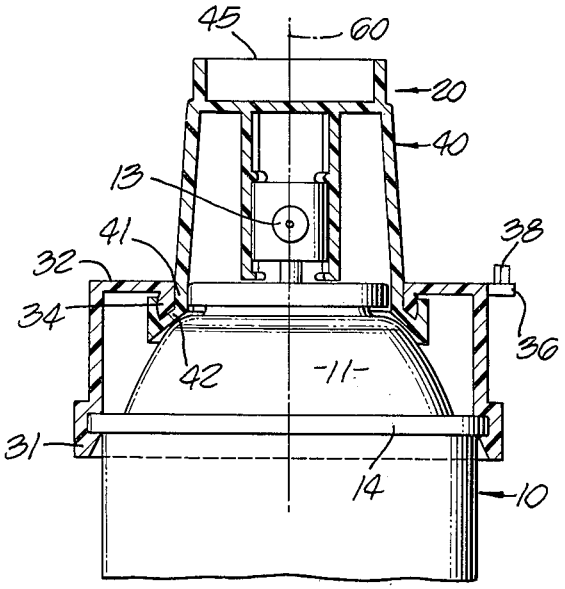
FIG. 5 is a transverse cross-sectional view taken on the line 5—5 of FIG. 4.

When the upper member 40 is in its aligned position as shown in FIGS. 3, 4, and 5, the members 30 and 40 cooperatively define a finger passageway for access to the push button or valve actuator 12. The mode of operation where the user inserts a single finger into the passageway is shown in FIG. 4. This result is made possible by the special configurations of both the lower member 30 and the upper member 40.

Figure 6:
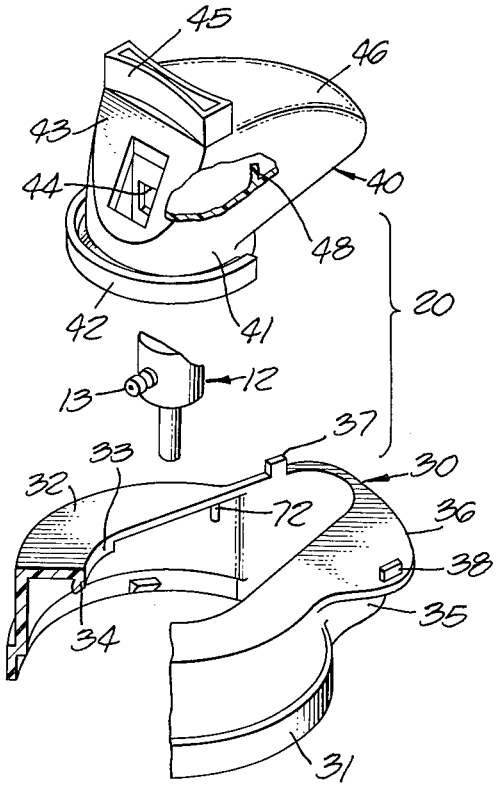
FIG. 6 is an exploded perspective view of the principal working parts of the safety cap.

More specifically, the lower member 30 has a circumferential portion 35 which is radially enlarged or extended relative to the lower rim-like portion 31, in order to provide a lower finger passageway portion 50. It will be understood, as best seen in FIGS. 4 and 6, that because of the radial enlargement 35 the rim-like portion 31 engages the bead or crimped edge 14 of container 10 through only about 300° of its circumference. The remaining approximately 60° of the rim-like portion 31 is radially expanded at 35 to provide the lower finger passageway portion 50 and hence does not directly engage the container bead 14. In a similar fashion the upper member 40 has a circumferential portion 46 which is radially enlarged so as to provide an upper finger passageway portion 51. The upper member 40 is of considerably smaller diameter measured in the horizontal direction than the lower member 30, but as will best be understood by reference to the plan views shown in FIGS. 3 and 9 the width of upper finger passageway portion 51 is approximately the same as the wdith of lower finger passageway 50. The circumferential portion 46 of upper member 40 which is radially enlarged to provide the finger passageway 51 is, therefore, a much larger portion of the total circumference of the upper member than is the case for the lower member. Specifically, the enlarged portion 46 accounts for approximately 170° of the circumference of the upper member 40. In order to provide a secure rotational interlock the rim-like portion 41 of upper member 40 is therefore extended at 47, 48 (FIGS. 3, 6, and 9) so as to partially cut off the interior side of the upper finger passageway 51.

The lower member 30 also has, on one side of the radial extension 35, a radially extending platform 36. The platform 36 is a radial extension of the top wall 32 of the lower member 30. Platform 36 provides no function in the aligned position of the upper member 40, shown in FIGS. 3 through 5. However, in the non-aligned position as shown in FIGS. 9 and 10 it is effective to block access to the upper finger passageway portion 51, and hence block finger access to the valve actuator 12.

A pair of stops 37, 38 are formed on the upper surface of top wall 32 of lower member 30. The stop 37 limits the rotation of upper member 40 as it approaches its aligned position. The stop member 38, located on the extreme edge of platform 36, limits the rotation of upper member 40 as it approaches its non-aligned position.

The lower member 30 is preferably formed as a single integral member from relatively rigid plastic material. The upper member 40 is likewise preferably integrally formed as a single plastic member. It will be understood that some resilience in the plastic material facilitates the inter-engagement of the locking flanges 34, 42, and it will also be understood that some resilience of the plastic material is advantageously used in latching the rim-like portion 31 to the container bead 14.

The spring 70 shown in FIGS. 3 and 9 is used in order to hold the upper member 40 normally in its non-aligned position. A small finger or hook 71 is formed on the exterior surface of flange 42 at a point which is circumferentially displaced a relatively short distance from the rim extension 47. A single finger or hook 72 is formed on the interior wall of the lower member 30 a small circumferential distance away from the enlargement 35, and on the side thereof opposite to the platform 36. Spring 70 is a small tension spring and its ends are fastened on the hooks 71, 72 respectively. Spring 70 lies in a horizontal plane only slightly below the elevation of the top wall 32 of the lower member 30, and more specifically at about the level of the upwardly facing recess in flange 42 of upper member 40. The effect of spring 70, as will be easily understood from FIG. 9 is to impel the upper member 40 towards its non-aligned position, where it is stopped by the stop 38. When a user wishes to dispense the contents of the aerosol container 10 he must therefore use one hand to rotate the upper member 40 to its aligned position, and then use a finger of the other hand to enter the aligned passageways 50, 51. From this mode of operation it is clear that a child-safe result is achieved.

The hooks 71, 72 may be integrally molded portions of the plastic members 40 and 30, respectively, but it may very well be preferred to use metal hooks or rivets which are attached to the plastic members as a separate and subsequent manufacturing operation.

The invention has been described in considerable detail in order to comply with the patent laws by providing a full public disclosure of at least one of its forms. However, such detailed description is not intended in any way to limit the broad features or principles of the invention, or the scope of patent to be granted.

What is claimed is:

1. An aerosol safety cap comprising:

a generally bowl-shaped lower member disposed in an inverted position and having a lower rim-like portion adapted for securement to the upper end of an aerosol container;

a generally cup-shaped upper member disposed in an inverted position and having a lower rim-like portion which supportingly engages the top wall of said lower member in a rotatable relationship therewith, whereby said upper member may be rotated about a vertical axis relative to said lower member;

said lower member having a central opening in the top wall thereof to permit a valve actuator associated with the aerosol container to extend upward into the interior of said upper member, and said upper member having a window formed in one sidewall thereof to permit a dispensing nozzle associated with the valve actuator to dispense aerosol spray into the surrounding atmosphere;

each of said members having a circumferential portion which is radially enlarged, said radially enlarged portions cooperating in a first rotational alignment position of said upper member relative to said lower member so as to provide a finger passageway to the valve actuator; and said lower member on one side of its enlarged portion having a radial extension of the top wall thereof, said extension effectively blocking finger entry into the enlarged portion of said upper member when said upper member occupies a second rotational alignment position relative to said lower member.

2. A safety cap as claimed in claim 1 which further includes stop means cooperating with said two members for permitting said upper member to rotate between said first position and said second position.

3. A safety cap as claimed in claim 2 which further includes spring means normally holding said upper member in said second position.

4. A safety cap as claimed in claim 1 wherein the rim-like portion of said upper member extends through said central opening of said top wall of said lower member and has an outwardly extending circumferential flange thereon which engages the under surface of said top wall.

5. A safety cap as claimed in claim 1 wherein the vertical height of said upper member is approximately equal to the vertical height of said lower member.

6. An aerosol safety cap comprising a lower member and an upper member, said lower member including a horizontally extending platform portion, said upper member including a finger passageway portion, said upper member being rotatably supported upon said lower member for rotation about a vertical axis relative to said lower member between first and second rotational alignment positions, the configuration of said members being such that in the first position of said upper member said two members cooperatively provide a downwardly opening finger passageway for access to the interior of the safety cap, but in the second position of said upper member, the horizontally extending platform portion of the lower member blocks finger access to the finger passageway portion of the upper member.

* * * * *